US007692595B2

(12) United States Patent
Kim

(10) Patent No.: US 7,692,595 B2
(45) Date of Patent: Apr. 6, 2010

(54) BROADBAND INTERNAL ANTENNA COMBINED WITH MONOPOLE ANTENNA AND LOOP ANTENNA

(75) Inventor: Sung-Min Kim, Seongnam-si (KR)

(73) Assignee: KT Tech, Inc., Seongnam-si, Gyeonggi-do (KR)

( * ) Notice: Subject to any disclaimer, the term of this patent is extended or adjusted under 35 U.S.C. 154(b) by 120 days.

(21) Appl. No.: 12/073,626

(22) Filed: Mar. 7, 2008

(65) Prior Publication Data

US 2009/0073048 A1 Mar. 19, 2009

(30) Foreign Application Priority Data

Sep. 14, 2007 (KR) ..... 10-2007-0093875

(51) Int. Cl.
*H01Q 21/00* (2006.01)

(52) U.S. Cl. ..... 343/728; 343/702; 343/725

(58) Field of Classification Search ..... 343/700 MS, 343/702, 725, 728

See application file for complete search history.

(56) References Cited

U.S. PATENT DOCUMENTS 7,307,591 B2 * 12/2007 Zheng ..... 343/702
7,352,326 B2 * 4/2008 Korva et al. ..... 343/700 MS
7,379,027 B2 * 5/2008 Kezys et al. ..... 343/702
7,482,985 B2 * 1/2009 Qi et al. ..... 343/702

* cited by examiner

*Primary Examiner*—Tan Ho
(74) *Attorney, Agent, or Firm*—Harness, Dickey & Pierce, P.L.C.

(57) ABSTRACT

Provided is a broadband internal antenna including a ground plate and an antenna unit. The antenna unit can include a feed point; a first radiator, formed with a bar shape having the feed point as one end part and the other end part from which an uncurved 'C' shape is extended; a ground point, connected to the ground plate; a second radiator, having one end part on which the ground point is mounted and the other end part that is connected to an area from which the uncurved 'C' shape of the first radiator starts to be formed in an open loop form; a first protrusion part, protruded from the uncurved 'C' shape of the first radiator to be formed in a closed loop form; and a second protrusion part, formed inside the open loop shape of the first radiator in an inverse L' form.

12 Claims, 12 Drawing Sheets

BROADBAND INTERNAL ANTENNA COMBINED WITH MONOPOLE ANTENNA AND LOOP ANTENNA

CROSS-REFERENCE TO RELATED PATENT APPLICATIONS

This application claims the benefit of Korean Patent Application No. 10-2007-0093875, filed on Sep. 14, 2007, in the Korean Intellectual Property Office, the disclosure of which is incorporated herein in its entirety by reference.

BACKGROUND OF THE INVENTION

1. Field of the Invention

The present invention relates to a broadband internal antenna, more specifically to a broadband internal antenna combined with a monopole antenna and a loop antenna.

2. Background Art

Today's rapid development of analog and digital communication technologies has internationally made it possible to execute various mobile community type services such as a cellular type, a personal communication system (PCS) type, a global system for mobile communication (GSM) type, a personal handy system (PHS) type and an iridium type using a satellite. In Korean, the cellular type, the PCS type and a CT-2 have been in service. In addition, a digital cordless system (DCS) type, a universal mobile telecommunications system (UMTS) type, a WiBro type and a wireless LAN (WLAN) type are in service or in preparation.

Also, the software defined radio (SDR) technology which is the next generation technology capable of suggesting the solution for system integration of the times of multi-standards, multi-bands (or broad-bands) and multi-services has globally been studied and developed. The SDR technology can process signals having from a baseband to a radio frequency (RF)/intermediate frequency (IF) band by using the elements capable of re-constitution such as high-speed digital signal processing and a field programmable gate array (FPGA). The SDR technology, which makes ceaseless communication by downloading software having the object-oriented structure to a single terminal hardware platform having the open structure in order to construct the system that is flexibly applicable to various wireless mobile communication environments, is a new system that can simultaneously provide multi-standard and multi-processing frequencies, unifying various actual communication systems in the current mobile communication market, and a variety of mobile communication services.

In particular, in the U.S., the SDR technology started from the necessity of a single system capable of making continuous communications no matter when and no matter where the military operations are executed. The traditionally-used communication equipment, which makes communication by using military communication infrastructure, is unable to receive an operation execution command in an area beyond the service region or through a damaged military network. Accordingly, it is necessary to develop the system that can make the continuous communication and is flexibly applicable to the change of the communication technology in the army. In 1995, the U.S. Department of Defense started and succeeded in the SPEAKeasy, which is the project for developing the system that can modify the service standard and execute the independent operation of hardware by changing application programs based on a hardware platform performing the common functions. This leaded to the increased investment in developing the SDR system and the start of the JTRS project for defining the object-orient based structure.

Similarly, in Europe, the SDR technology-related projects have proceeded in various forms since 1994. Furthermore, the today's SDR technology, which is considered as the next generation technology for economical benefits as well as the military goal, has started to arouse the interest of companies and has resulted in the worldwide studies through universities and various R&D centers. Based on this, the SDR communication system is expected to be applicable to not only base stations but also personal terminal systems. Accordingly, the multi-band (or broad-band) antennas that are suitable to use the SDR system have been studied and developed in the antenna field.

A variety of current multi-band (or broad-band) antennas such as a broadband antenna that can include all usable frequencies of various mobile communication services through the improvement of a band width, a reconfigurable antenna using the on/off of a signal such as a chip diode and an antenna using the multiple-resonance have been under development. This requires more compact broadband antenna to be suitable for the portability of the mobile communication terminal and to be used in broader frequency bands.

SUMMARY OF THE INVENTION

The present invention provides a broadband internal antenna that can include usable frequencies of variable communication services.

The present invention also provides a more compact broadband internal antenna ac compared with the conventional broadband internal antenna.

The present invention also provides a compact broadband internal antenna that can be used in a broader frequency band as compared with the conventional broadband internal antenna.

An aspect of the present invention features a broadband internal antenna device including a ground plate and an antenna unit. At this time, the antenna unit can include a feed point; a first radiator, formed with a bar shape having the feed point as one end part and the other end part from which a rectangular shape with one side open (i.e. an uncurved 'C' shape) is extended; a ground point, connected to the ground plate; a second radiator, having one end part on which the ground point is mounted and the other end part that is connected to an area from which the uncurved 'C' shape of the first radiator starts to be formed in an open loop form; a first protrusion part, protruded from the uncurved 'C' shape of the first radiator to be formed in a closed loop form; and a second protrusion part, formed inside the open loop shape of the first radiator in an 'inverse L' form.

Here, an end part of antenna can be bended at a predetermined angle, the end part including the feed point and the ground point.

The predetermined angle can be 90 degree.

An upper part of antenna of the antenna unit can be bended at a predetermined angle.

The predetermined angle can be 90 degree

A center part of antenna of the antenna unit can be bended at a predetermined angle.

The predetermined angle can be 90 degree

The ground plate can have the size of 75 mm×42 mm.

The antenna unit can be mounted in a cube structure having the size of 14 mm×37 mm×3.5 mm The first radiator can function as a monopole antenna.

The second radiator can function as a loop antenna.

The broadband internal antenna device can have an impedance bandwidth between 0.849 GHz and 0.963 GHz.

The broadband internal antenna device can have an impedance bandwidth between 1.350 GHz and 2.560 GHz.

A length between the feed point and an end part of the first radiator can correspond to a quarter of the wavelength of resonant frequency at the lower band, the end part being the other end part of the first radiator.

BRIEF DESCRIPTION OF THE DRAWINGS

These and other features, aspects and advantages of the present invention will become better understood with regard to the following description, appended Claims and accompanying drawings where:

DESCRIPTION OF THE EMBODIMENTS

Figure 1:
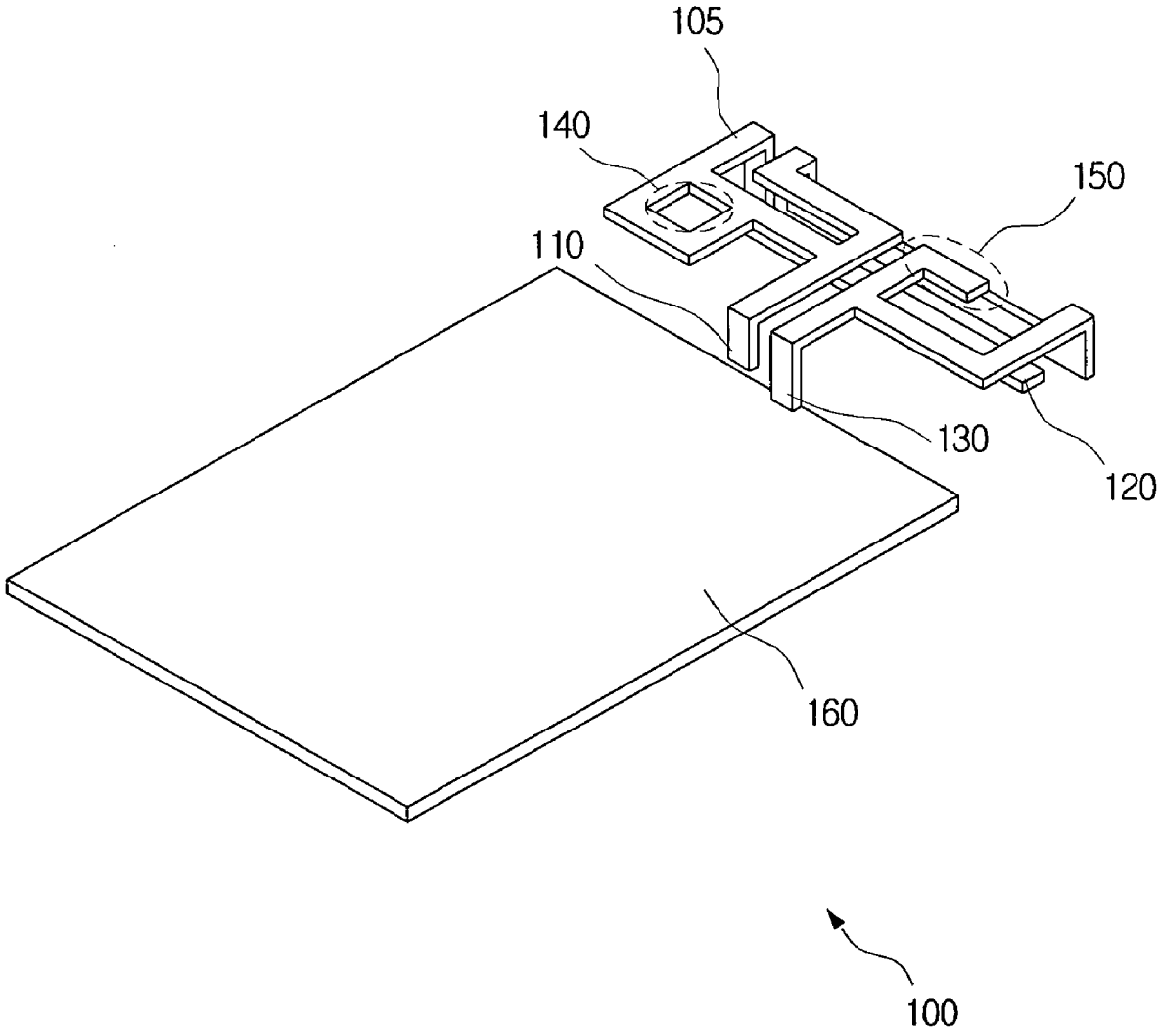
FIG. 1 is a perspective view showing a broadcast internal antenna device in accordance with an embodiment of the present invention.

Since there can be a variety of permutations and embodiments of the present invention, certain embodiments will be illustrated and described with reference to the accompanying drawings. This, however, is by no means to restrict the present invention to certain embodiments, and shall be construed as including all permutations, equivalents and substitutes covered by the spirit and scope of the present invention. Throughout the drawings, similar elements are given similar reference numerals. Throughout the description of the present invention, when describing a certain technology is determined to evade the point of the present invention, the pertinent detailed description will be omitted.

Terms such as "first" and "second" can be used in describing various elements, but the above elements shall not be restricted to the above terms. The above terms are used only to distinguish one element from the other.

The terms used in the description are intended to describe certain embodiments only, and shall by no means restrict the present invention. Unless clearly used otherwise, expressions in the singular number include a plural meaning. In the present description, an expression such as "comprising" or "consisting of" is intended to designate a characteristic, a number, a step, an operation, an element, a part or combinations thereof, and shall not be construed to preclude any presence or possibility of one or more other characteristics, numbers, steps, operations, elements, parts or combinations thereof.

Hereinafter, some embodiments of the present invention will be described in detail with reference to the accompanying drawings.

Figure 2:
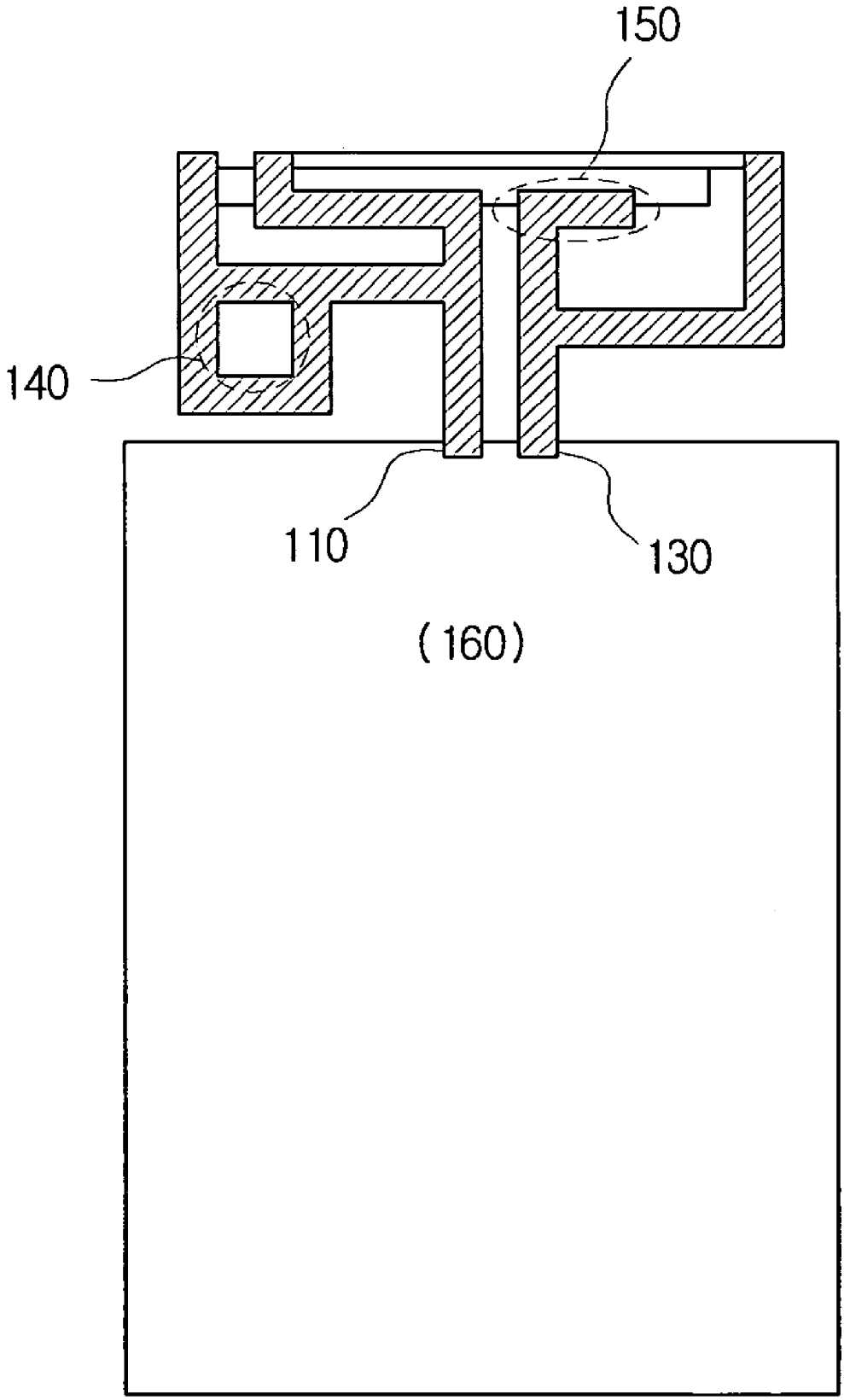
FIG. 2 is a plan view showing a broadcast internal antenna device in accordance with an embodiment of the present invention.
Figure 3:
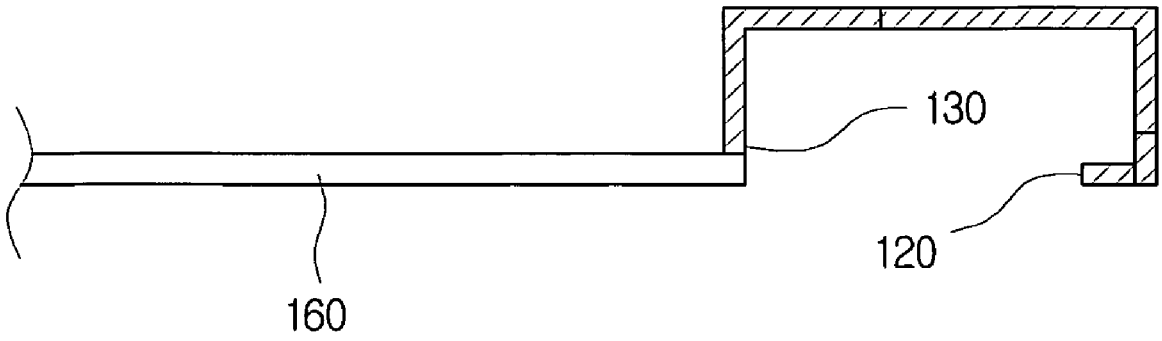
FIG. 3 is a lateral side view showing a broadcast internal antenna device in accordance with an embodiment of the present invention.
Figure 4:
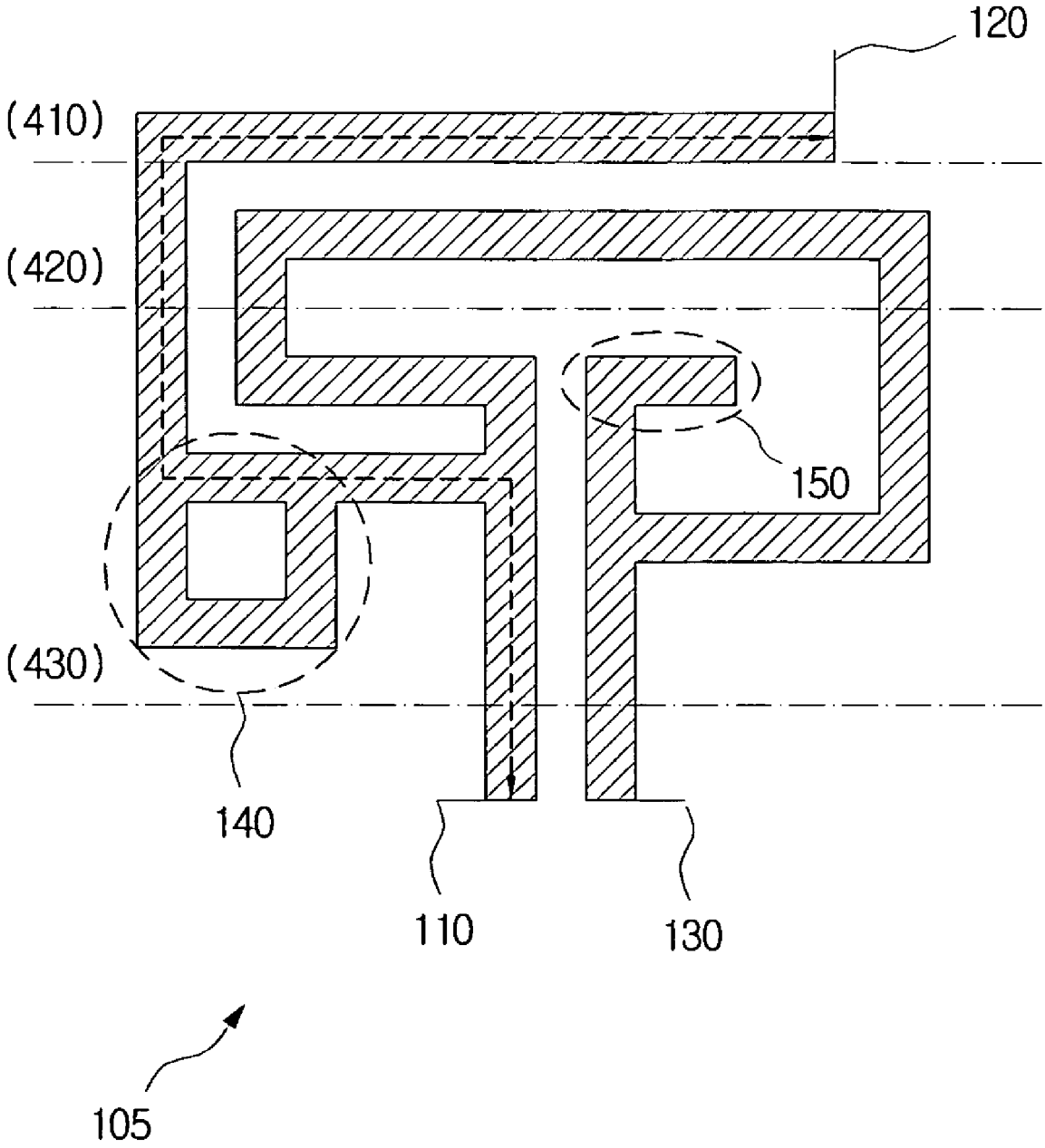
FIG. 4 shows the antenna unit in accordance with an embodiment of the present invention if the antenna were laid open in a flat plane.

FIG. 1 is a perspective view showing a broadcast internal antenna device in accordance with an embodiment of the present invention, and FIG. 2 is a plan view showing a broadcast internal antenna device in accordance with an embodiment of the present invention. FIG. 3 is a lateral side view showing a broadcast internal antenna device in accordance with an embodiment of the present invention, and FIG. 4 shows the antenna unit in accordance with an embodiment of the present invention if the antenna were laid open in a flat plane. Hereinafter, the shape of the antenna device 100 in accordance with an embodiment of the present invention will be described with reference to FIG. 1 through FIG. 4.

Referring to FIG. 1, the broadcast internal antenna device 100 in accordance with an embodiment of the present invention can include an antenna unit 105 and a ground plane 160, and the antenna unit 105 can be formed at a side part of the ground plate 160. The antenna unit 105 can also include a first radiator and a second radiator. A feed point 110 can be equipped in the first radiator, and a ground point 130 can be equipped at an end part of the second radiator. At this time, the ground point 130, as shown in FIG. 1, can be connected to the ground plate 160, and the feed point 110 may be disconnected to the ground plate 160.

Also, the broadcast internal antenna device 100 in accordance with an embodiment of the present invention can further include a dielectric substrate (not shown), and the antenna unit 105 can be formed at one surface of the dielectric substrate (not shown). For example, the relatively low cost 'FR-4' can be used for the material of the dielectric substrate (not shown). Of course, the material of the dielectric substrate (not shown) is not limited to the 'FR-4.' Alternatively, at least one of epoxy, Duroid, Teflon, Bakelite, high-resistance silicon, glass, aluminum oxide, low temperature co-fired ceramics (LTCC) and air form can be used. In accordance with the embodiment of the present invention, a FR-4 substrate having the thickness of 1 mm and the relative permittivity of 4.4 is used for the material of the dielectric substrate (not shown). Of course, it is obvious that the thickness and the relative permittivity of the dielectric substrate (not shown) are limited to this embodiment of the present invention.

Also, the first radiator included in the antenna unit 105 can have the feed point 110 and an end point 120 of the first radiator as opposite end points. At this time, the first radiator can have a bar shape having the feed point as one end part and the other end part from which a rectangular shape with one side open (i.e. an uncurved 'C' shape) is extended. At this time, the first radiator can be connected to the below-described second radiator to function as a shorted monopole antenna. Accordingly, the length between the feed point 110 and the end point 120 of the first radiator 120 can correspond to a quarter of the wavelength of resonant frequency at the lower band. Thus, the resonant frequency of the lower band can be affected by the length between the feed point 110 and the end point 120 of the first radiator. Also, each of 3 different parts of the first radiator can be bended perpendicularly.

A lower part of the uncurved 'C' shape of the first radiator can be connected to a first protrusion part 140 having the 'U' shape. Accordingly, the first protrusion part 140 can form a closed loop (or ring) shape by being connected to the lower part of the uncurved 'C' shape of the first radiator. Along with a below-described second protrusion part 150, the first protrusion part 140 may have an affect on the electrical characteristic (e.g. input impedance) of the broadband internal antenna 100 in all frequency bands. This will be described later with reference to FIG. 8.

The second radiator included in the antenna unit 105, as shown in the pertinent figures, can having one end part on which the ground point 130 is mounted, and the ground point 130 can be connected to the ground plate 160. The second radiator can also form an open loop (i.e. a loop with a part open) generally by allowing the other end part (i.e. the other end part different from the one end part on which the ground point 130) to be connected to the area at which the uncurved 'C' shape is extended. Accordingly, the first radiator can be connected to the second radiator. Also, the open loop shape part of the second radiator can be bended along with the uncurved 'C' shape of the first radiator. This will be described later.

The resonance of a fundamental band and/or the resonance of a higher band can also be added by the second radiator. In other words, the second radiator generally having the loop shape can function as a loop antenna. Through this, the resonance of a fundamental band and/or the resonance of a higher band can be added.

Also, the second protrusion part 150 having the 'inverse L' shape can be formed at an area of the open loop shape of the second radiator. Here, the area is close to the ground point 130. Along with the first protrusion part 140, the second protrusion part 150 may have an affect on the electrical characteristic (e.g. input impedance) of the broadband internal antenna 100 in all frequency bands. This will be described later with reference to FIG. 8.

Referring to FIG. 2, FIG. 3 and FIG. 4, the antenna unit 105 can be bended perpendicularly according to each of crease lines 410, 420 and 430. Here, the crease lines 410, 420 and 430 can be the assumed lines for bending the antenna unit 150. At this time, a first crease line 410 can be set to allow an upper part of the uncurved 'C' shape having the end point 120 of the first radiator (hereinafter, referred to as an 'upper part of antenna) to be bended. A second crease line 420 can be set to allow a center part of the uncurved 'C' shape and the loop part of the second radiator (hereinafter, referred to as a 'center part of antenna') together to be bended. Finally, a third crease line 430 can be set to allow a predetermined part having a feed point 110 of the first radiator and a predetermined part having the ground point 120 of the second radiator (hereinafter, referred to as an 'end part of antenna) to be bended.

Accordingly, the antenna unit 105 can be divided into an upper part, a center part, a lower part and an end part of the antenna. The upper part based on the first crease line 410 is defined as the upper part of the antenna. The part between the first crease line 410 and the second crease line 420 is defined as the center part of the antenna. The part between the second crease line 420 and the third crease line 430 is defined as the lower part of the antenna. Finally, the lower part based on the third crease line 430 (i.e. a part including the feed point 110 and the ground point 130) is defined as the end part of the antenna.

At this time, the antenna unit 105 can be bended perpendicularly in the same direction according to each of the 3 aforementioned crease lines 410, 420 and 430. Accordingly, the plane surface of the antenna unit 105 can have the shape as shown in FIG. 2, and the lateral side surface can have the shape as shown in FIG. 3. These shapes also make it possible to reduce the space on which the antenna unit 105 is mounted. Accordingly, in accordance with an embodiment of the present invention, the antenna device 100 can be used as an internal antenna employed for a portable terminal (e.g. a mobile communication terminal and a personal digital assistant (PDA)).

Also, the fourth crease line (not shown) can be set to allow the first protrusion part only to be bended. Accordingly, it is obvious that the first protrusion part 140 can be bended according to the fourth crease line (not shown), and this makes it possible to increasingly reduce the space on which the antenna unit 105 is mounted.

The below description is mainly related to the shape of the broadband internal antenna device 100 in accordance with an embodiment of the present invention. Even though the description assumes that the antenna unit 100 is bended at a right angle, this is merely an example. In other words, the antenna unit 105 can be bended at an acute angle or at a obtuse angle. The ground plate 160 and the first radiator, the second radiator, the first protrusion part 140 and/or the second protrusion part 150, included in the antenna unit 105, can have their sizes, each of which is differently set according to the resonant frequency and the wavelength. Hereinafter, the antenna device in which each element has a limited size in accordance with another embodiment of the present invention will be described with reference to FIG. 4 through FIG. 7.

Figure 5:
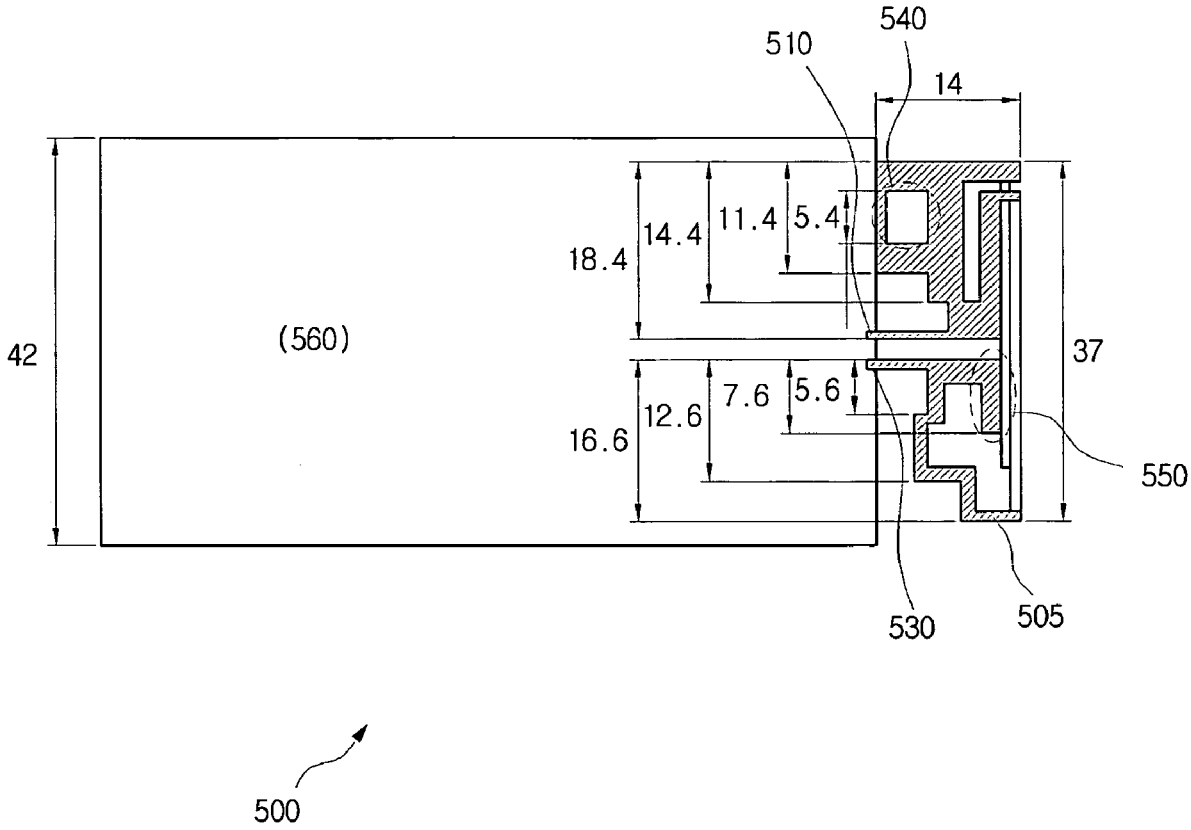
FIG. 5 is a plan view showing a broadcast internal antenna device in another embodiment of the present invention.
Figure 6:
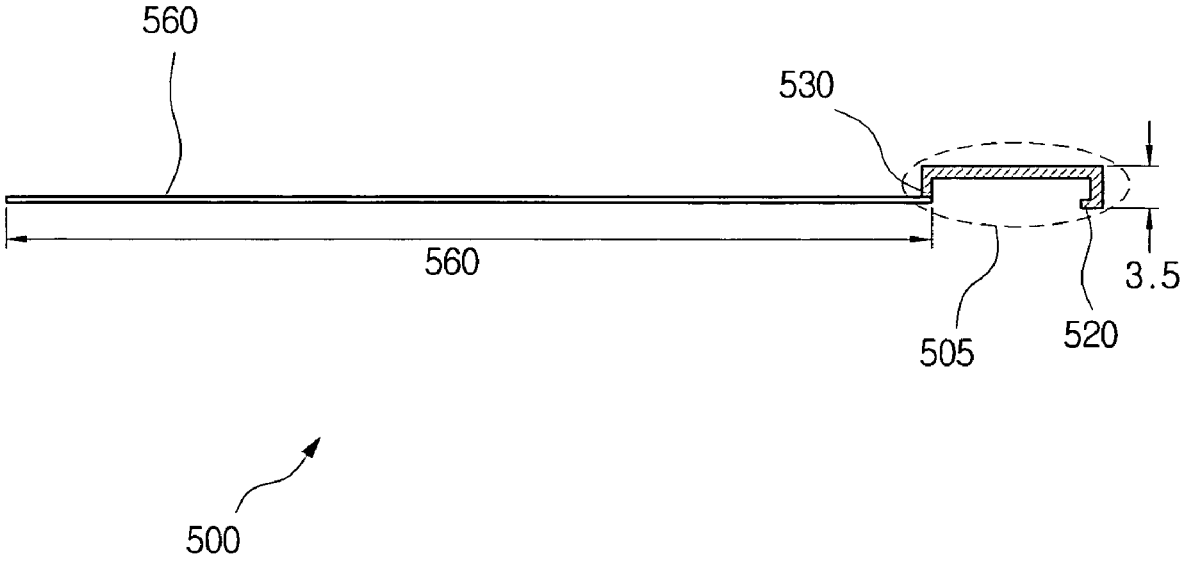
FIG. 6 is a lateral side view showing a broadcast internal antenna device in another embodiment of the present invention.
Figure 7:
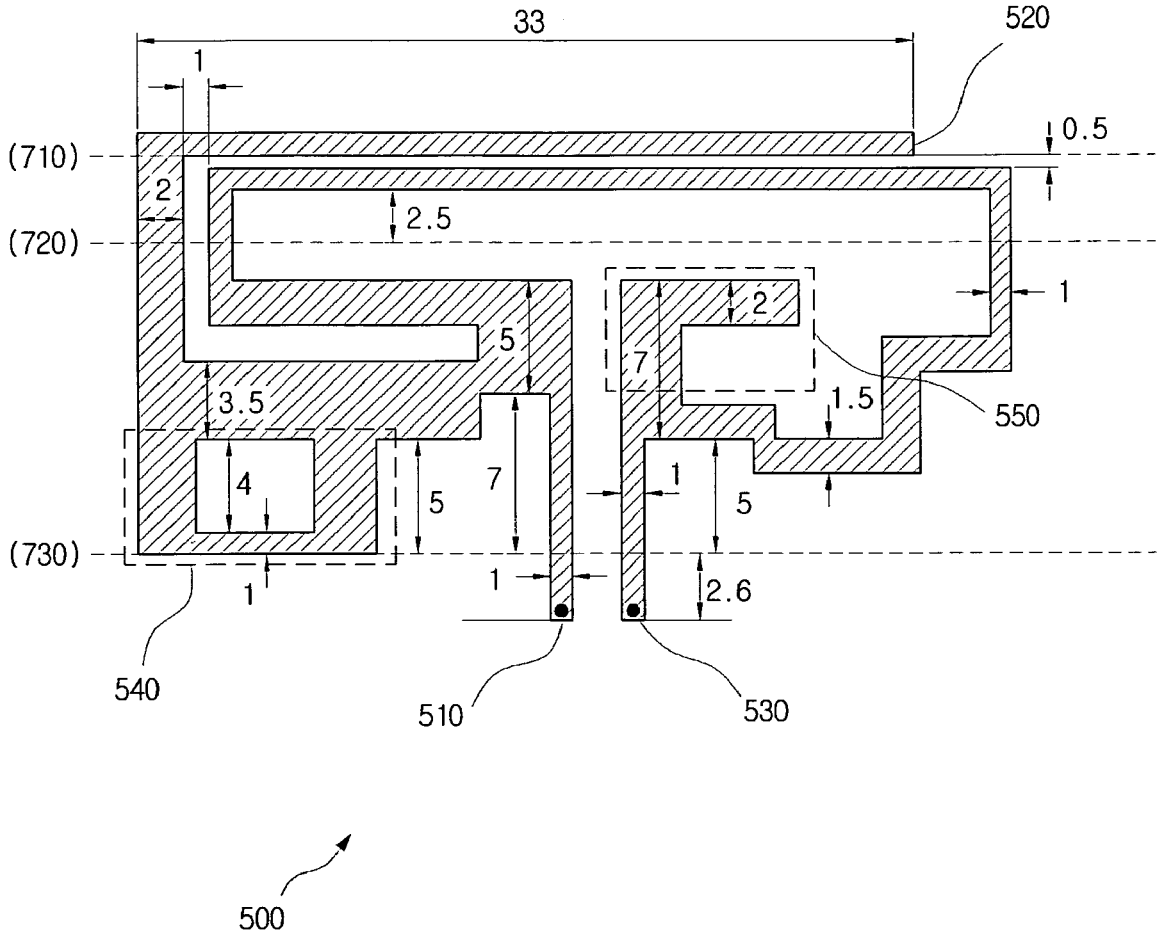
FIG. 7 shows the antenna unit in accordance with another embodiment of the present invention if the antenna were laid open in a flat plane.

FIG. 5 is a plan view showing a broadcast internal antenna device in another embodiment of the present invention, and FIG. 6 is a lateral side view showing a broadcast internal antenna device in another embodiment of the present invention. FIG. 7 shows the antenna unit in accordance with another embodiment of the present invention if the antenna were laid open in a flat plane (here, the unit is millimeter).

Referring to the attached FIG. 5 through FIG. 7, the broadband internal antenna device 500 in accordance with another embodiment of the present invention (hereinafter, referred to as a 'second broadband internal antenna device 500' to be distinguished from the broadband internal antenna device 100 described with reference to FIG. 1 through FIG. 4) is similar to the broadband internal antenna device 100 in accordance with an embodiment of the present invention which has been described with reference to FIG. 1 through FIG. 4. In other words, the broadband internal antenna device 500 in accordance with another embodiment of the present invention includes a second antenna unit 505 and a second ground plate 560. A ground point 530 of the second antenna unit 505 is connected to a side part of the second ground plate 560. Also, the second antenna unit 505, as shown in FIG. 6, is bended 3 times.

Identically to the first antenna unit 105, in the second antenna unit 505, a part functioning as the monopole antenna (hereinafter, referred to as a 'third radiator') and a part functioning as a loop antenna (hereinafter, referred to as a 'fourth radiator') are connected to each other. Also, the second antenna unit 505 is formed with the third protrusion part 540 and the fourth protrusion part 550 which may have an affect on the electrical characteristic (e.g. input impedance) of the broadband internal antenna 500 in all frequency bands in accordance with another embodiment of the present invention.

The broadband internal antenna device 500 in accordance with another embodiment of the present invention can further include a dielectric substrate (not shown), and the antenna unit 505 can be formed at a surface of the dielectric substrate (not shown). For example, 'FR-4' can be used for the material of the dielectric substrate (not shown). Identically to the broadband internal antenna device 100 in accordance with the embodiment of the present invention, in another embodiment, a FR-4 substrate having the thickness of 1 mm and the relative permittivity of 4.4 is also used for the material of the dielectric substrate (not shown). Of course, it is obvious that the thickness and the relative permittivity of the dielectric substrate (not shown) are limited to this embodiment of the present invention.

However, unlike the first antenna unit 105, the second antenna unit 505 can be formed with at least one corner. Referring to FIG. 7, a corner is formed close to the third protrusion part 540 of the third radiator, and two corners 740-1 and 740-2 are formed close to the fourth protrusion part 550 of the fourth radiator. It is obvious that the corners 740-1, 740-2 and 740-3 can have a minute affect on the electrical characteristic of antenna and this can be proved through a test or a simulation.

Also, the second broadband internal antenna device 500 may have each size such as the thickness and volume different from the first broadband internal antenna device 100. For example, the second broadband internal antenna device 500 can have each element having the size as shown in FIG. 5 though FIG. 7. Here, the unit is millimeter. In more detail, the second ground plate 560 can have a horizontal length 75 mm and a vertical length 42 mm. After being bended 3 times, the second antenna unit 505 can have a horizontal length 14 mm, a vertical length 37 mm and a height 3.5 mm. In other words, the second antenna unit 505 can be mounted on the cube structure of 14 mm×37 mm×3.5 mm.

Here, since the sizes of the second broadband internal antenna device 500 shown in FIG. 5 through FIG. 7 are merely an example, it is obvious that this gives no restriction to the scope of claims of the present invention.

Figure 8:
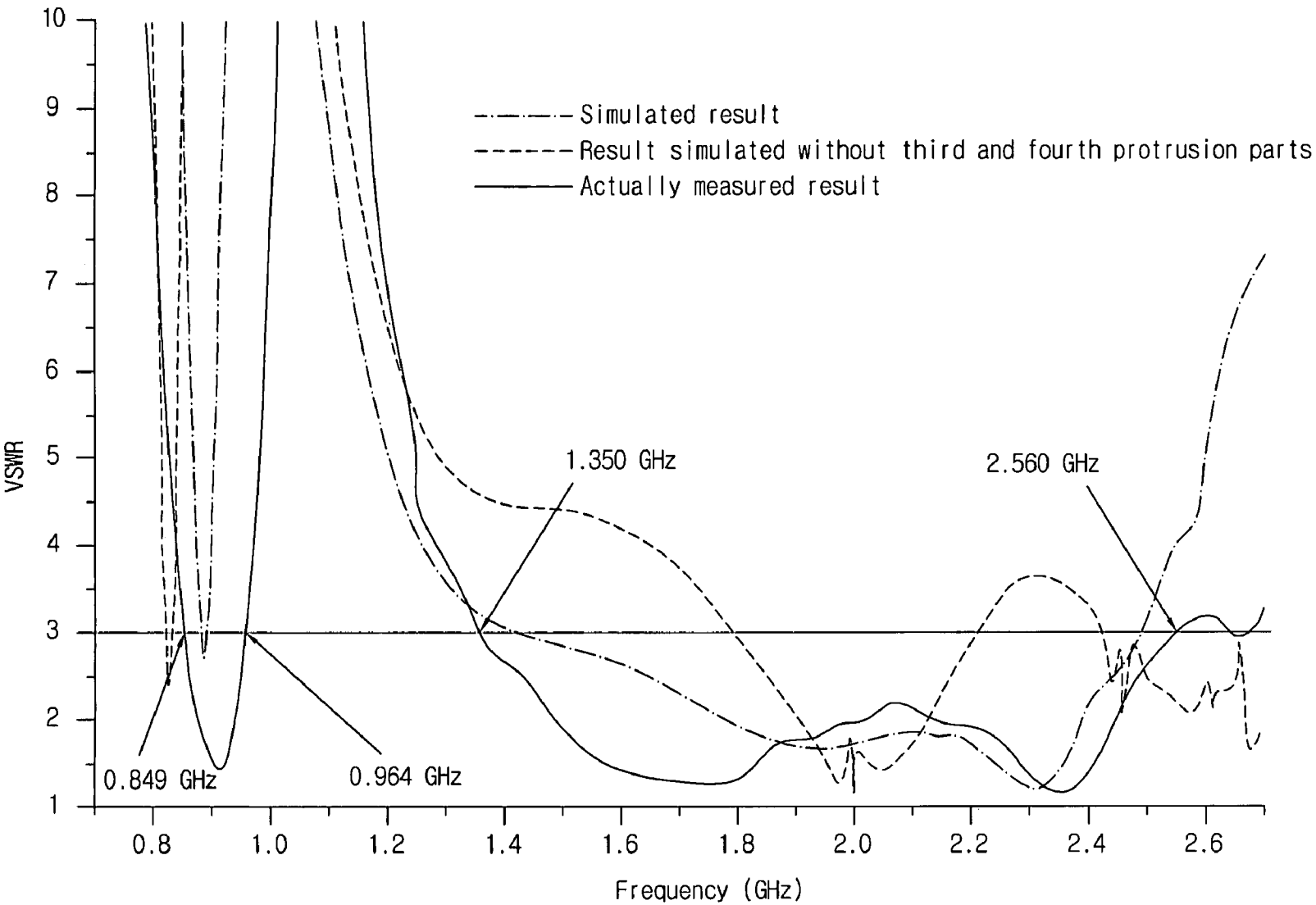
FIG. 8 shows graphs of each measured result of the voltage standing wave ratio (VSWR) that is the electrical characteristic of a broadcast internal antenna device in accordance With an embodiment of the present invention.

FIG. 8 shows graphs of each measured result of the voltage standing wave ratio (VSWR) that is the electrical characteristic of a broadcast internal antenna device in accordance with an embodiment of the present invention.

Hereinafter, the measured result of the voltage standing wave ratio (VSWR) of the broadband internal antenna device in accordance with the present invention (e.g. the second broadband internal antenna device 500) will be described with reference to FIG. 8. Here, the VSWR indicates the value evaluated by dividing a value that evaluated by adding 1 to a reflection coefficient by a value that evaluated by subtracting the reflection coefficient from 1 (i.e. the VSWR=(1+reflection coefficient)/(1−reflection coefficient)).

The graphs illustrate the VSWR result according to the simulation of the broadband internal antenna device 500, the VSWR result according to the simulation performed without the third protrusion part 540 and the fourth protrusion part 550 and the VSWR result according to the actual measurement using the broadband internal antenna device 500. At this time, the VSWR result of the second broadband internal antenna device 500 is the result of the simulation conducted through the Semcad X software, and the electrical characteristic of the second broadband internal antenna device 500 such as a return loss was measured through a HP 8720C network analyzer. Of course, it is obvious that the simulation conducted through an Ansoft HFSS can have the same or similar result.

Referring to FIG. 8, it can be recognized that the VSWR result according to the actually measured result is nearly similar to the VSWR result according to the simulation. According to the actually measured result, it can be recognized that the impedance bandwidth of a lower band (i.e. the bandwidth in case that the VSWR is 3 or less) is 114 MHz (i.e. from 0.849 GHz to 0.963 GHz), and the impedance bandwidth of a baseband and a higher band is 1210 MHz (i.e. from 1.350 GHz to 2.560 GHz).

Accordingly, the impedance bandwidth of the broadband internal antenna device 500 includes all bandwidths such as GSM (0.88~0.96 GHz), GPS (1.575 GHz), DCS (1.71~1.88 GHz), UMTS (1.91~2.17 GHz), WiBro (2.30~2.39 GHz) and/or WLAN (2.40~2.50 GHz).

Referring to FIG. 8, it can be recognized that the VSWR result according to the simulation performed without the third protrusion part 540 and the fourth protrusion part 550 shows the third protrusion part 540 and the fourth protrusion part 550 has an affect on the input impedance of the second broadband internal antenna device 500. In other words, it can be recognized that the second broadband internal antenna device without the third protrusion part 540 and the fourth protrusion part 550 has the considerably narrow impedance bandwidth corresponding to the baseband and the higher band. Also, it can be recognized that the second broadband internal antenna device without the third protrusion part 540 and the fourth protrusion part 550 has the considerably narrow impedance bandwidth corresponding to the lower band.

Accordingly, it can be recognized that the third protrusion part 540 and the fourth protrusion part 550 enlarges the impedance bandwidth of the second broadband internal antenna device 500.

Figure 9A:
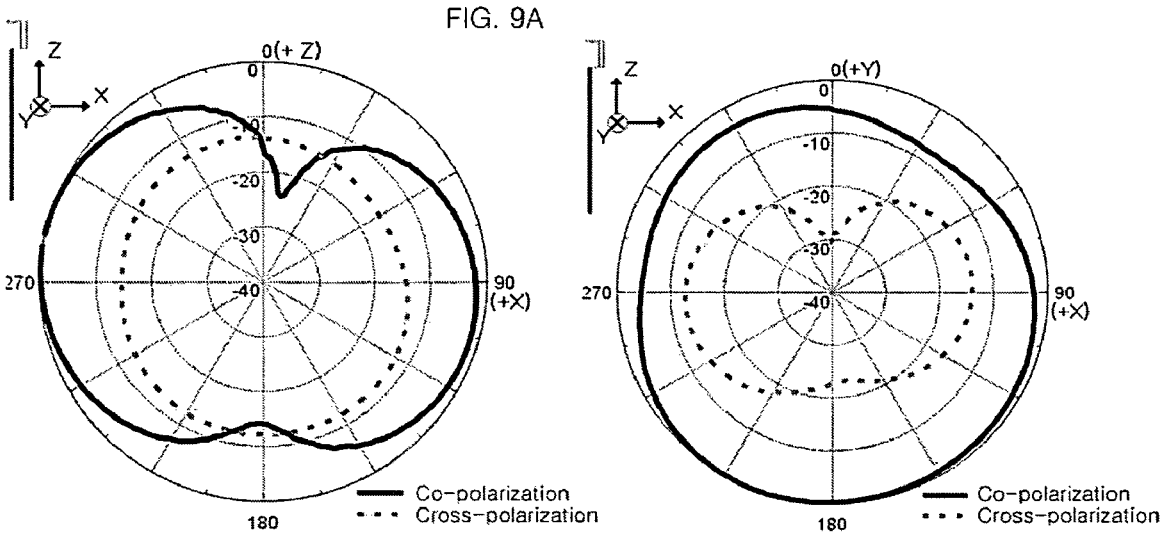
FIG. 9A shows a measured result of the radiation characteristic in the frequency of 0.92 GHz of a broadcast internal antenna device in accordance with the present invention.
Figure 9B:
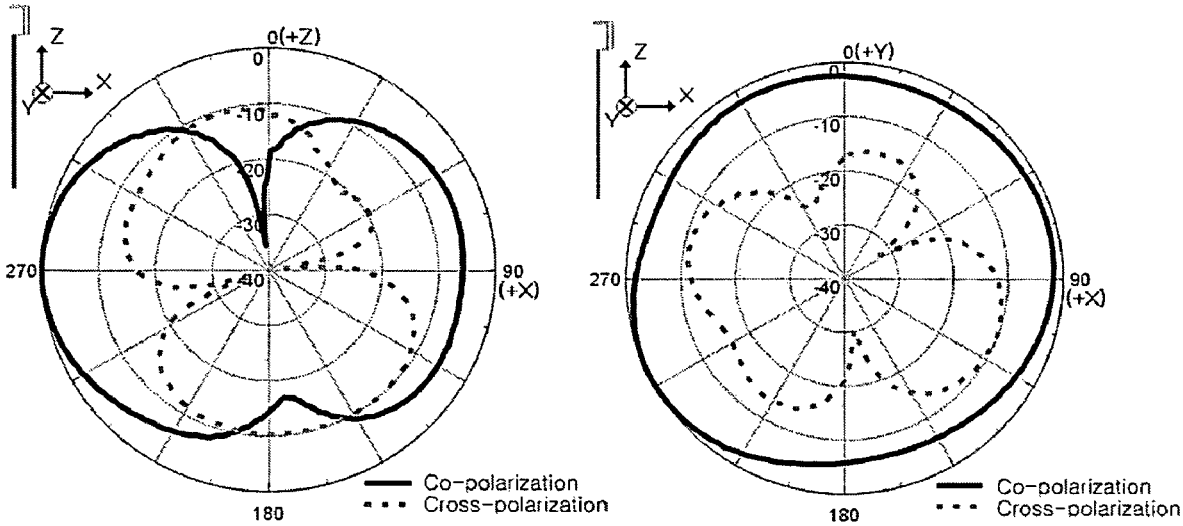
FIG. 9B shows a measured result of the radiation characteristic in the frequency of 1.575 GHz of a broadcast internal antenna device in accordance with the present invention.
Figure 9C:
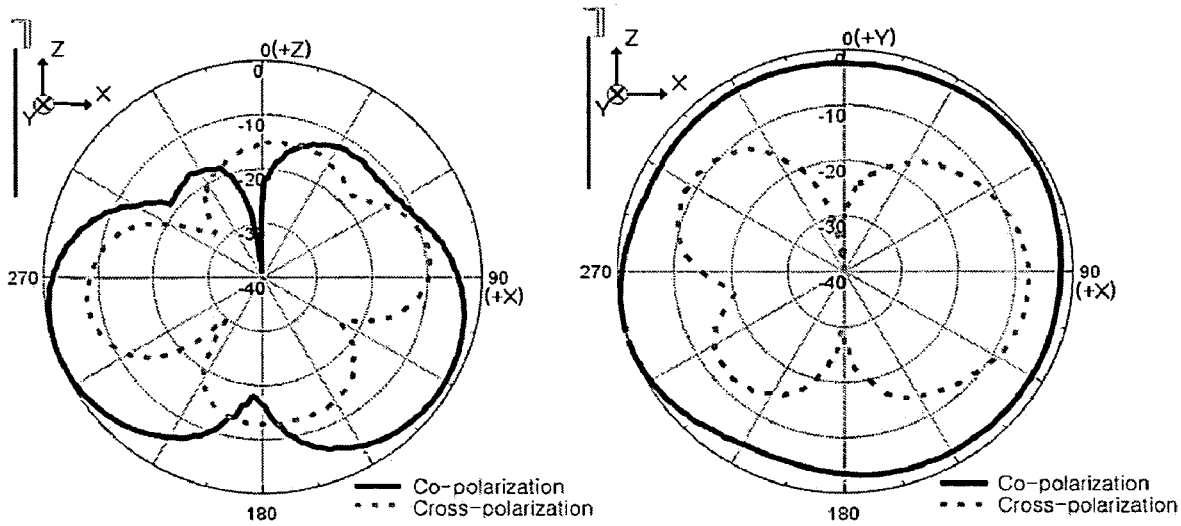
FIG. 9C shows a measured result of the radiation characteristic in the frequency of 1.94 GHz of a broadcast internal antenna device in accordance with the present invention.
Figure 9D:
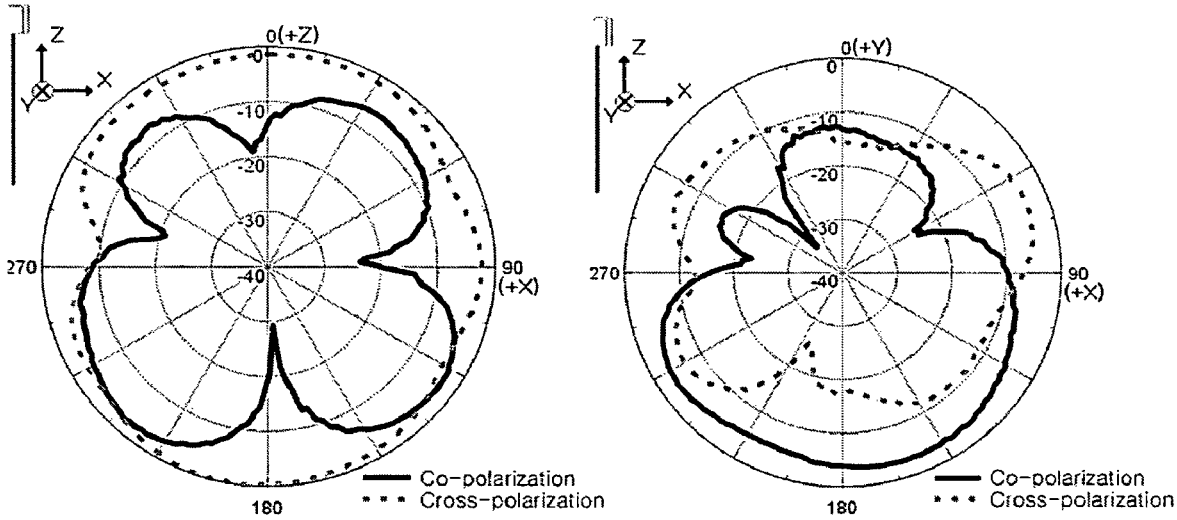
FIG. 9D shows a measured result of the radiation characteristic in the frequency of 2.40 GHz of a broadcast internal antenna device in accordance with the present invention.

FIG. 9A shows a measured result of the radiation characteristic in the frequency of 0.92 GHz of a broadcast internal antenna device in accordance with the present invention, and FIG. 9B shows a measured result of the radiation characteristic in the frequency of 1.575 GHz of a broadcast internal antenna device in accordance with the present invention. FIG. 9C shows a measured result of the radiation characteristic in the frequency of 1.94 GHz of a broadcast internal antenna device in accordance with the present invention, and FIG. 9D shows a measured result of the radiation characteristic in the frequency of 2.40 GHz of a broadcast internal antenna device in accordance with the present invention.

Referring to FIG. 9A, it can be recognized that the broadband internal antenna device 500 represents omni-directional radiation patterns at the frequency of 0.92 GHz that is the center frequency of the GSM band.

Referring to FIG. 9B, it can be recognized that the broadband internal antenna device 500 represents omni-directional radiation patterns at the frequency of 0.92 GHz that is the center frequency of the GPS band.

Referring to FIG. 9C, it can be recognized that the broadband internal antenna device 500 represents omni-directional radiation patterns at the frequency of 1.940 GHz that is the center frequency of the DCS band, the PCS band and the UMTS band.

Referring to FIG. 9D, it can be recognized that the broadband internal antenna device 500 represents omni-directional radiation patterns at the frequency of 2.40 GHz that is the center frequency of the WiBro band and WLAN band.

In other words, it can be recognized that the broadband internal antenna device 500 represents omni-directional radiation patterns at the lower band between 0.849 GHz and 0.963 GHz and the baseband and the higher band between 1.350 GHz and 2.560 GHz.

Hitherto, although some embodiments of the present invention have been shown and described for the above-described objects, it will be appreciated by any person of ordinary skill in the art that a large number of modifications, permutations and additions are possible within the principles and spirit of the invention, the scope of which shall be defined by the appended claims and their equivalent.

What is claimed is:

1. A broadband internal antenna device, comprising:

a ground plate; and an antenna unit, whereas the antenna unit comprises a feed point;

a first radiator, formed with a bar shape having the feed point as one end part and the other end part from which a rectangular shape with one side open is extended to form an uncurved 'C' shape;

a ground point, connected to the ground plate;

a second radiator, having one end part on which the ground point is mounted and the other end part that is connected to an area from which the uncurved 'C' shape of the first radiator starts to be formed in an open loop form;

a first protrusion part, protruded from the uncurved 'C' shape of the first radiator to be formed in a closed loop form; and a second protrusion part, formed inside the open loop shape of the first radiator in an 'inverse L' form.

2. The device of claim 1, wherein an end part of antenna is bended at a predetermined angle, the end part including the feed point and the ground point.

3. The device of claim 2, wherein the predetermined angle is 90 degree.

4. The device of claim 2, wherein an upper part of antenna of the antenna unit is bended at a predetermined angle.

5. The device of claim 4, wherein the predetermined angle is 90 degree.

6. The device of claim 4, wherein a center-part of antenna of the antenna unit is bended at a predetermined angle.

7. The device of claim 6, wherein the predetermined angle is 90 degree.

8. The device of claim 1, wherein the ground plate has the size of 75 mm×42 mm.

9. The device of claim 6, wherein the antenna unit is mounted in a cube structure having the size of 14 mm×37 mm×3.5 mm.

10. The device of claim 1, wherein the first radiator functions as a monopole antenna.

11. The device of claim 1, wherein the second radiator functions as a loop antenna.

12. The device of claim 1, wherein a length between the feed point and an end part of the first radiator corresponds to a quarter of the wavelength of resonant frequency at the lower band, the end part being the other end part of the first radiator.

* * * * *